US010587040B2

(12) United States Patent
Sudo et al.

(10) Patent No.: US 10,587,040 B2
(45) **Date of Patent: *Mar. 10, 2020**

(54) ANTENNA MODULE ACCOMMODATION STRUCTURE

(71) Applicant: Murata Manufacturing Co., Ltd., Kyoto (JP)

(72) Inventors: Kaoru Sudo, Kyoto (JP); Ryuken Mizunuma, Kyoto (JP); Masayuki Nakajima, Kyoto (JP); Masanori Tsuji, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/420,259

(22) Filed: May 23, 2019

(65) Prior Publication Data

US 2019/0280376 A1 Sep. 12, 2019

Related U.S. Application Data

(63) Continuation of application No. 15/484,176, filed on Apr. 11, 2017, now Pat. No. 10,340,588, which is a (Continued)

(30) Foreign Application Priority Data

Oct. 16, 2014 (JP) ..... 2014-212106

(51) Int. Cl.
*H01Q 1/24* (2006.01)
*H01Q 1/42* (2006.01)
(Continued)

(52) U.S. Cl.
CPC ..... *H01Q 1/42* (2013.01); *H01Q 1/12* (2013.01); *H01Q 21/28* (2013.01); *H01Q 1/243* (2013.01);
(Continued)

(58) Field of Classification Search
CPC ..... H01Q 1/243; H01Q 1/3275; H01Q 1/42; H01Q 7/00; H01Q 13/106; H01Q 1/12
(Continued)

(56) References Cited

U.S. PATENT DOCUMENTS 10,340,588 B2 * 7/2019 Sudo et al.
2008/0129638 A1 6/2008 Ong
(Continued)

FOREIGN PATENT DOCUMENTS

JP 2001-243443 A 9/2001
JP 2004-005653 A 1/2004
(Continued)

OTHER PUBLICATIONS

U.S. Appl. No. 15/484,176, filed Apr. 2017.*
International Search Report for PCT/JP2015/077246 dated Nov. 10, 2015.
(Continued)

*Primary Examiner* — Joseph J Lauture
(74) *Attorney, Agent, or Firm* — Pearne & Gordon LLP

(57) ABSTRACT

As such, in the disclosure, a slit is formed in a side plate. The slit has an opening in the upper end surface of the side plate. The opening has a width which is smaller than a thickness of the side plate and enables to correspond to a thickness t of the substrate and a length which enables to correspond to a length a of one side of the substrate. An RF antenna module is housed in the slit formed in the side plate of the housing to be accommodated in the housing by inserting the one side of the substrate through the opening of the slit, which is formed in the upper end surface of the side plate, and inserting the substrate into the slit by an amount equal to or larger than a length of another side of the substrate.

19 Claims, 5 Drawing Sheets

Related U.S. Application Data continuation of application No. PCT/JP2015/077246, filed on Sep. 28, 2015.

(51) Int. Cl.

| | |
|---|---|
| ***H01Q 1/12*** | (2006.01) |
| ***H01Q 21/28*** | (2006.01) |
| *H01Q 13/10* | (2006.01) |
| *H01Q 1/32* | (2006.01) |
| *H01Q 7/00* | (2006.01) |

(52) U.S. Cl.
CPC ..... *H01Q 1/32* (2013.01); *H01Q 1/3275* (2013.01); *H01Q 7/00* (2013.01); *H01Q 13/106* (2013.01)

(58) Field of Classification Search
USPC ..... 343/702, 700, 722, 770, 767
See application file for complete search history.

(56) References Cited

U.S. PATENT DOCUMENTS

| | | | |
|---|---|---|---|
| 2012/0194377 | A1 | 8/2012 | Yukumatsu et al. |
| 2013/0321220 | A1 | 12/2013 | Toujo |

FOREIGN PATENT DOCUMENTS

| | | | |
|---|---|---|---|
| JP | 2004-258044 | A | 9/2004 |
| JP | 3138503 | U | 1/2008 |
| JP | 2010-093501 | A | 4/2010 |
| JP | 2012-159349 | A | 8/2012 |

OTHER PUBLICATIONS

Written Opinion for PCT/JP2015/077246 dated Nov. 10, 2015.
Notice of Reasons for Rejection issued in Japanese Patent Application No. 2016-554033 dated Oct. 3, 2017.

* cited by examiner

ANTENNA MODULE ACCOMMODATION STRUCTURE

This is a continuation of U.S. patent application Ser. No. 15/484,176 filed on Apr. 11, 2017, which is a continuation of International Application No. PCT/JP2015/077246 filed on Sep. 28, 2015 which claims priority from Japanese Patent Application No. 2014-212106 filed on Oct. 16, 2014. The contents of these applications are incorporated herein by reference in their entireties.

BACKGROUND OF THE DISCLOSURE

Field of the Disclosure

The present disclosure relates to an antenna module accommodation structure that accommodates an antenna module configured by forming an antenna on a substrate in a housing.

Description of the Related Art

As an existing antenna module accommodation structure of this type, for example, there is a structure illustrated in FIG. 1, which is disclosed in Patent Document 1. A transmission and reception antenna 1 that transmits and receives millimeter radio waves is accommodated in a casing 2 and a radome 3 protecting the transmission and reception antenna 1 from bounding stones, rain, and the like is attached to the fore surface of the transmission and reception antenna 1. An antenna unit 11 is installed on a vehicle with metal brackets 16 and a shielding member 4 projecting from the fore surface of the antenna unit 11 is provided under the metal brackets 16.

Furthermore, Patent Document 2 discloses an accommodation structure for accommodating an electronic circuit module configured by a circuit substrate 7 and an antenna coil 8 in a resin case 9, which is illustrated in FIG. 2. An integrated circuit (IC) chip 6 is mounted on the circuit substrate 7 and the antenna coil 8 is connected to the circuit substrate 7 to transmit and receive information in the form of radio waves. The electronic circuit module is inserted into an elongated groove provided in the resin case 9 from a slit 10 to be accommodated in the resin case 9.

Moreover, Patent Document 3 discloses an antenna module accommodation structure configured by integrally molding an antenna module 20 in a case 21, which is illustrated in FIG. 3. The antenna module 2 is installed under a surface layer 101 of a plurality of main layers 100 before the main layers 100 are put into a cavity opened in a molding mold. Thereafter, the main layers 100 and the antenna module 20 soaked in resin are put together into the cavity and pressed and heated. With this process, the antenna module 20 is integrally molded in the case 21.

Patent Document 1: Japanese Unexamined Patent Application Publication No. 2004-258044

Patent Document 2: Japanese Unexamined Patent Application Publication No. 2001-243443

Patent Document 3: Japanese Registered Utility Model No. 3138503

BRIEF SUMMARY OF THE DISCLOSURE

However, in the above-mentioned existing antenna module accommodation structure disclosed in Patent Document 1, when the transmission and reception antenna 1 is attached to the radome 3, the fore surface of the transmission and reception antenna 1 needs to be fixed to the rear surface of the radome 3 with a double-faced adhesive tape or the like. Therefore, a gap for the double-faced adhesive tape or the like is formed between the transmission and reception antenna 1 and the radome 3 and the intensity of radio waves that are emitted from the transmission and reception antenna 1 toward the front fore side of the radome 3 with the radome 3 interposed therebetween is weakened and antenna characteristics are lowered.

In the above-mentioned existing antenna module accommodation structure disclosed in Patent Document 2, the antenna module configured by integrating the circuit substrate 7 and the antenna coil 8 is incorporated in the elongated groove provided in the resin case 9. Therefore, it is difficult to accommodate devices other than the antenna module in the resin case 9.

Furthermore, in the above-mentioned existing antenna module accommodation structure disclosed in Patent Document 3, the antenna module 20 is integrated with and accommodated in the case 21. Therefore, the main body layers 100 and the antenna module 20 soaked in the resin need to be put together into the cavity opened in the molding mold and pressed and heated for integrally molding the antenna module 20 in the case 21. Accordingly, a large number of processes are required for integrating and accommodating the antenna module 20 in the case 21, and it is impossible to easily accommodate the antenna module 20 therein.

The present disclosure has been conceived in order to solve the above-described problems and provides an antenna module accommodation structure with which an antenna module configured by forming an antenna in or on a substrate is housed in a slit formed in a side plate of a housing to be accommodated in the housing.

With this configuration, the antenna module is accommodated in the housing only by simply housing the antenna module in the slit formed in the side plate of the housing. Therefore, unlike the existing technique, the antenna module need not be fixed to the side plate of the housing with a double-faced adhesive tape or the like for accommodating the antenna module in the housing. Accordingly, no gap for the double-faced adhesive tape or the like is formed between the antenna and the side plate and the intensity of radio waves that are emitted from the antenna toward the fore side of the side plate with the side plate interposed therebetween is not weakened and antenna characteristics are improved.

Furthermore, the number of processes for mounting the antenna module in the housing is reduced because the antenna module is accommodated in the housing only by simply hosing the antenna module in the slit. Therefore, unlike the existing technique, the antenna module can be accommodated in the housing easily and rapidly without the process of putting the antenna module into a cavity opened in a molding mold and integrally molding with resin.

Moreover, the accommodation capacity for devices capable of being accommodated in the housing is not reduced because the antenna module is housed in the slit formed in the side plate of the housing and does not protrude into an internal space of the housing. Therefore, a problem that devices other than the antenna module cannot be accommodated in the housing due to accommodation of the antenna module therein is not raised unlike the existing technique.

In an aspect of the disclosure, the substrate has a thickness which is smaller than a thickness of the side plate, and the slit has, in an end surface of the side plate, an opening having a width which is smaller than the thickness of the side plate and enables to correspond to the thickness of the substrate and a length which enables to correspond to a length of one side of the substrate, and has a depth which is equal to or larger than a length of the other side of the substrate.

With this configuration, the antenna module is housed in the slit formed in the side plate of the housing easily and rapidly by inserting the one side of the substrate through the opening of the slit formed in the end surface of the side plate and inserting the substrate into the slit by an amount equal to or larger than the length of the other side of the substrate.

Furthermore, in an aspect of the disclosure, a depth of the slit is set in accordance with an arrangement position of the antenna module in the side plate.

With this configuration, the antenna module is accommodated in the slit at a predetermined arrangement position in the depth direction thereof only by inserting the antenna module into the slit down to the depth thereof to be simply housed in the slit. Therefore, a position in the depth direction of the slit at which the antenna module is mounted on the side plate is automatically determined only by performing a process of housing the antenna module in the slit and assembly of the antenna module in the housing is made easy.

Furthermore, in an aspect of the disclosure, a rear surface side of the side plate on a back side of the slit facing an internal portion of the housing is cut out and a cavity causing a part of the accommodated antenna module to be exposed to the internal portion of the housing is formed in the slit.

With this configuration, the position of the antenna module is fixed in the slit by pressing a part of the antenna module exposed to the cavity formed in the slit to the front side of the side plate at the fore side of the slit with a plate or the like or causing it to adhere to the plate or the like. Moreover, heat generated in the antenna module can be released from the plate or the like by fixing the antenna module in this manner.

Furthermore, in an aspect of the disclosure, the antenna is configured by a front-direction radiation antenna emitting radio waves toward a front fore side of the side plate exposed to an outside of the housing and a lateral-direction radiation antenna emitting radio waves in a lateral direction of the side plate.

In the existing antenna module accommodation structure with which the antenna module is fixed to the rear surface of the side plate with the double-faced adhesive tape or the like to be accommodated in the housing, the side plate is present on the fore side of the side ends of the substrate on which the lateral-direction radiation antennas are formed and spaces are present on the back side of the side ends of the substrate. Therefore, materials having different dielectric constants are asymmetrically present on the fore and back sides of the side ends of the substrate centered to the side ends of the substrate. Accordingly, radio waves that are emitted from the lateral-direction radiation antennas in the lateral directions of the side plate do not travel straight along the lateral directions of the side plate and propagate being biased to the fore and back directions of the side plate.

However, with the configuration in which the substrate is accommodated in the slit formed in the side plate, the side plate is equally present at the fore and back sides of the side ends of the substrate on which the lateral-direction radiation antennas are formed and a material having the same dielectric constant is symmetrically present centered to the side ends of the substrate. Accordingly, the radio waves that are emitted from the lateral-direction radiation antennas in the lateral directions of the side plate are difficult to be biased to the fore and back directions of the side plate, and components that propagate along the lateral directions of the side plate are increased. As a result, lateral-direction antenna characteristics of the lateral-direction radiation antennas are improved.

In an aspect of the disclosure, a thickness of the side plate at a front side on a fore side of the slit exposed to an outside of the housing is reduced at an internal portion side of the housing.

With this configuration, an amount by which the thickness of the side plate at the front side on the fore side of the slit is reduced at the internal portion side of the housing is adjusted to adjust a distance between the antenna formed on the fore surface of the substrate and the side plate present on the fore side of the substrate and the thickness of the side plate present on the fore side of the substrate. With this, a beam width and a radiation power level of the radio waves that the antennas formed on the fore surface of the substrate emit toward the front fore side of the side plate can respectively be set to a desired beam width and a desired radiation power level, thereby providing preferable antenna characteristics.

In an aspect of the disclosure, a thickness of the side plate at a front side on a fore side of the slit exposed to an outside of the housing is reduced at an outer portion side of the housing.

With this configuration, an amount by which the thickness of the side plate at the front side on the fore side of the slit is reduced at the outer portion side of the housing is adjusted to adjust the thickness of the side plate present on the fore side of the antenna formed on the fore surface of the substrate. With this, a beam width and a radiation power level of the radio waves that the antennas formed on the fore surface of the substrate emit toward the front fore side of the side plate can respectively be set to a desired beam width and a desired radiation power level, thereby providing preferable antenna characteristics.

According to the present disclosure, an antenna module accommodation structure improving antenna characteristics, enabling an antenna module to be accommodated in a housing easily and rapidly, and causing no reduction in an accommodation capacity for devices capable of being accommodated in the housing can be provided.

DETAILED DESCRIPTION OF THE DISCLOSURE

Next, modes for carrying out an antenna module accommodation structure according to the disclosure will be described.

Figure 4A:
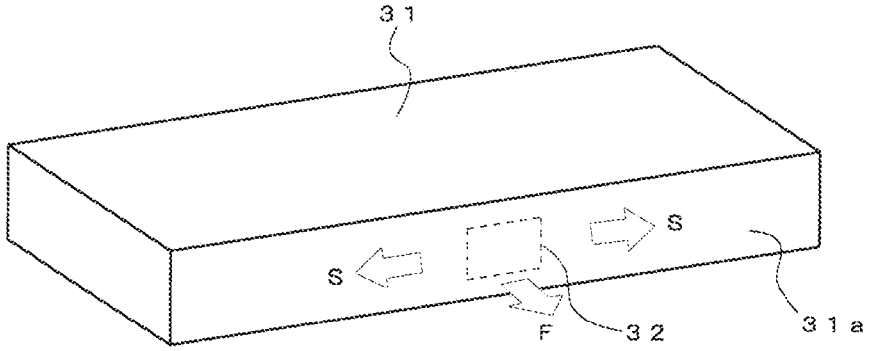
FIG. 4A is an outer appearance perspective view of a housing to which an antenna module accommodation structure according to each of embodiments of the disclosure is applied.

FIG. 4A is an outer appearance perspective view of a housing 31 to which an antenna module accommodation structure according to each of embodiments of the disclosure is applied. The housing 31 is made of resin and has a hollow box shape, and rectangular side plates are formed on respective surfaces of a hexahedron. A radio frequency (RF) antenna module 32 is accommodated in a side plate 31*a* located at the front side of the housing 31 with the antenna module accommodation structure in each of the embodiments.

Figure 4B:
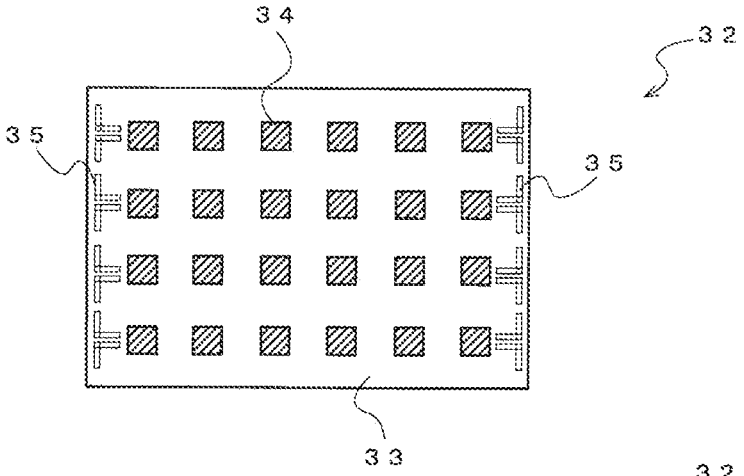
FIG. 4B is a plan view of a radio frequency (RF) antenna module that is accommodated in the housing illustrated in FIG. 4A.
Figure 4C:
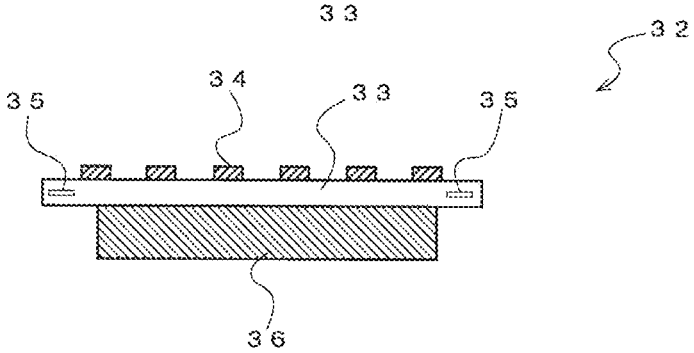
FIG. 4C is a side view of the RF antenna module.

FIG. 4B is a plan view of the RF antenna module 32 and FIG. 4C is a side view thereof. The RF antenna module 32 is a communication module with antennas and is configured by forming the antennas on a substrate 33. A plurality of patch antennas 34 as front-direction radiation antennas are formed on the fore surface of the substrate 33, and a plurality of dipole antennas 35 as lateral-direction radiation antennas are formed on both the side ends of the substrate 33. A metal case 36 is mounted on the back surface of the substrate 33, and a high-frequency device configuring an RF part is mounted on the back surface of the substrate 33 in the metal case 36. The RF part is connected to a baseband (BB) IC card (not illustrated) incorporated in the housing 31 with a cable.

Figure 5A:
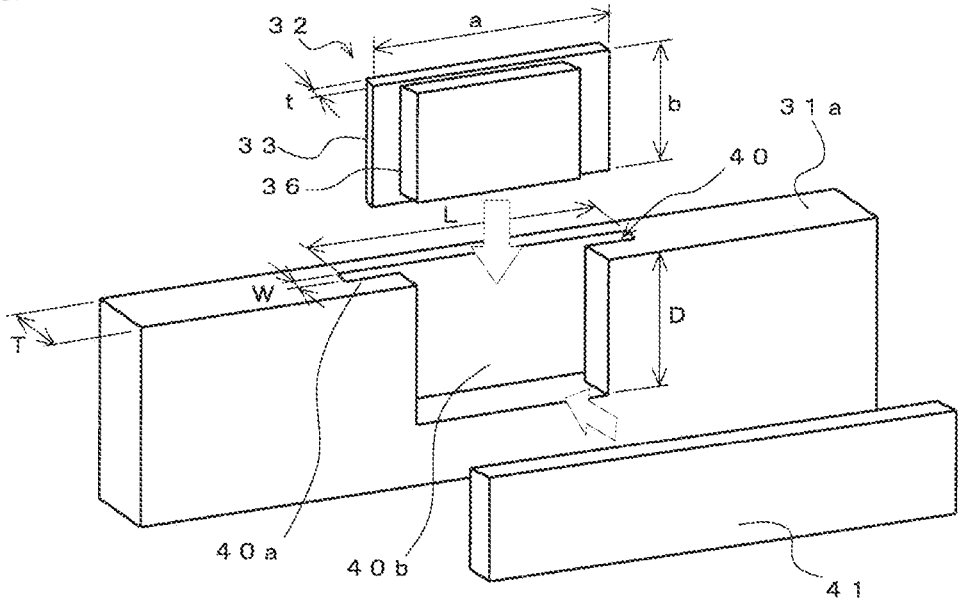
FIG. 5A is a partially enlarged perspective view in which respective components are seen from the rear surface side of a side plate when the RF antenna module is accommodated in the side plate with an antenna module accommodation structure in a first embodiment of the disclosure.
Figure 5B:
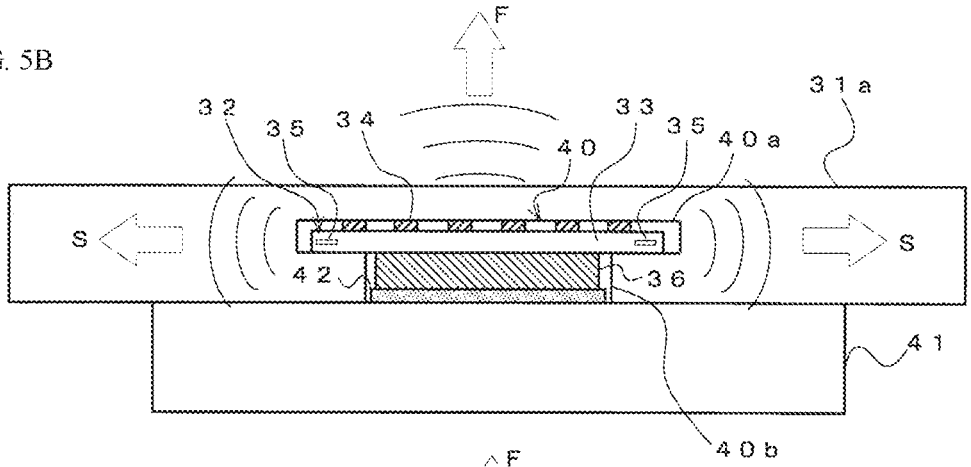
FIG. 5B is a plan view illustrating the antenna module accommodation structure in the first embodiment.
Figure 5C:
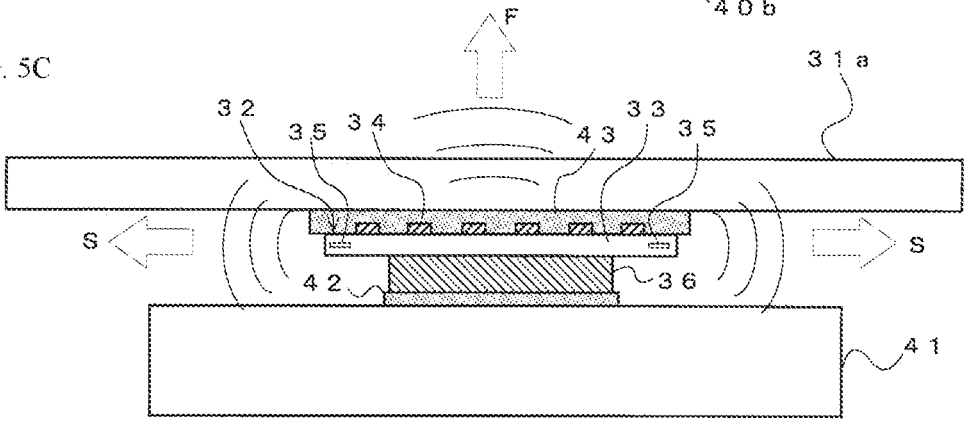
FIG. 5C is a plan view illustrating an existing antenna module accommodation structure.

FIG. 5A is a partially enlarged perspective view in which respective components are seen from the rear surface side of the side plate 31*a* when the RF antenna module 32 is accommodated in the side plate 31*a* with the antenna module accommodation structure in a first embodiment of the disclosure. In FIGS. 5A, 5B and 5C, the same reference numerals denote the portions that are the same as or correspond to those in FIGS. 4A, 4B and 4C and description thereof is omitted.

A slit 40 is formed in the side plate 31*a*. The slit 40 has an opening 40*a* in the upper end surface of the side plate 31*a*. The opening 40*a* has a width W which is smaller than a thickness T of the side plate 31*a* and enables to correspond to a thickness t of the substrate 33 and a length L which enables to correspond to a length a of one side on a longer side of the substrate 33. The substrate 33 has the thickness t which is smaller than the thickness T of the side plate 31*a*. Furthermore, the slit 40 has a depth D which is equal to or larger than a length b of the other side, which is a side on a shorter side, of the substrate 33. The depth D of the slit 40 is set in accordance with an arrangement position of the RF antenna module 32 in the height direction in the side plate 31*a*. In the embodiment, the depth D is set to be equal to the length b of the other side.

The RF antenna module 32 is housed in the slit 40 formed in the side plate 31*a* of the housing 31 to be accommodated in the housing 31 by, from the upper side of the side plate 31*a*, inserting the one side on the longer side of the substrate 33 through the opening 40*a* of the slit 40, which is formed in the upper end surface of the side plate 31*a*, and inserting the substrate 33 into the slit 40 by an amount equal to or larger than the length b of the other side on the shorter side of the substrate 33.

In the embodiment, a cavity 40*b* is formed in the slit 40 by cutting out the rear surface side of the side plate 31*a* at the back side of the slit 40 facing an internal portion of the housing 31 into a rectangular shape. Both the side ends of the substrate 33 of the RF antenna module 32 are held between opposing side walls of the slit 40. The cavity 40*b* causes the metal case 36 as a part of the RF antenna module 32 housed in the slit 40 to be exposed to the internal portion of the housing 31. In the embodiment, a plate-shaped heat sink 41 is bonded to the metal case 36 exposed to the cavity 40*b* with a double-faced adhesive tape 42 as illustrated in FIG. 5B.

FIG. 5B is a plan view illustrating the RF antenna module 32 accommodated in the side plate 31*a* and illustrates the antenna module accommodation structure in the first embodiment. The heat sink 41 is fixed to the rear surface of the side plate 31*a* with screws at both end portions with the cavity 40*b* interposed therebetween. The fixing of the heat sink 41 causes the heat sink 41 to press the metal case 36 exposed to the cavity 40*b* to the front side of the side plate 31*a* on the fore side of the slit 40 with the double-faced adhesive tape 42 interposed therebetween and fixes a position of the RF antenna module 32 in the slit 40.

The RF antenna module 32 housed in the slit 40 emits millimeter radio waves toward the front fore side of the side plate 31*a* exposed to the outside of the housing 31 in an arrow direction F (see FIG. 4A and FIG. 5B) by the patch antennas 34 configuring the front-direction radiation antennas. Furthermore, the RF antenna module 32 emits millimeter radio waves in arrow directions S (see FIG. 4A and FIG. 5B) as the lateral directions of the side plate 31*a* by the dipole antennas 35 configuring the lateral-direction radiation antennas.

Figure 6A:
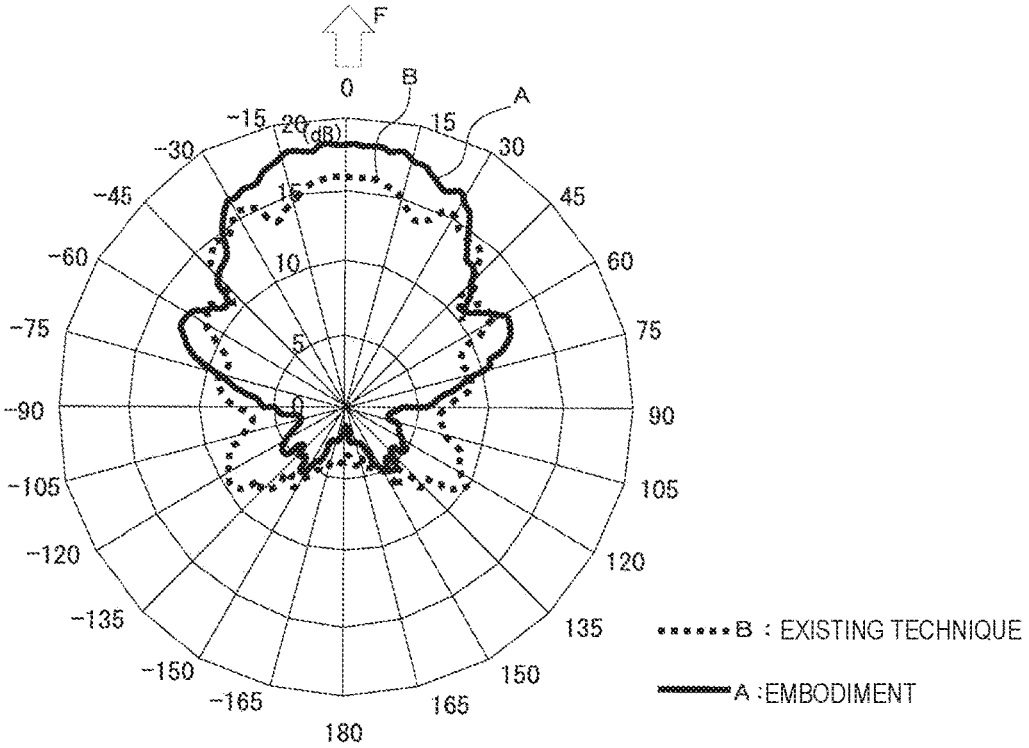
FIG. 6A is a directivity diagram for comparing front-direction antenna radiation patterns of patch antennas between the embodiment and the existing technique.
Figure 6B:
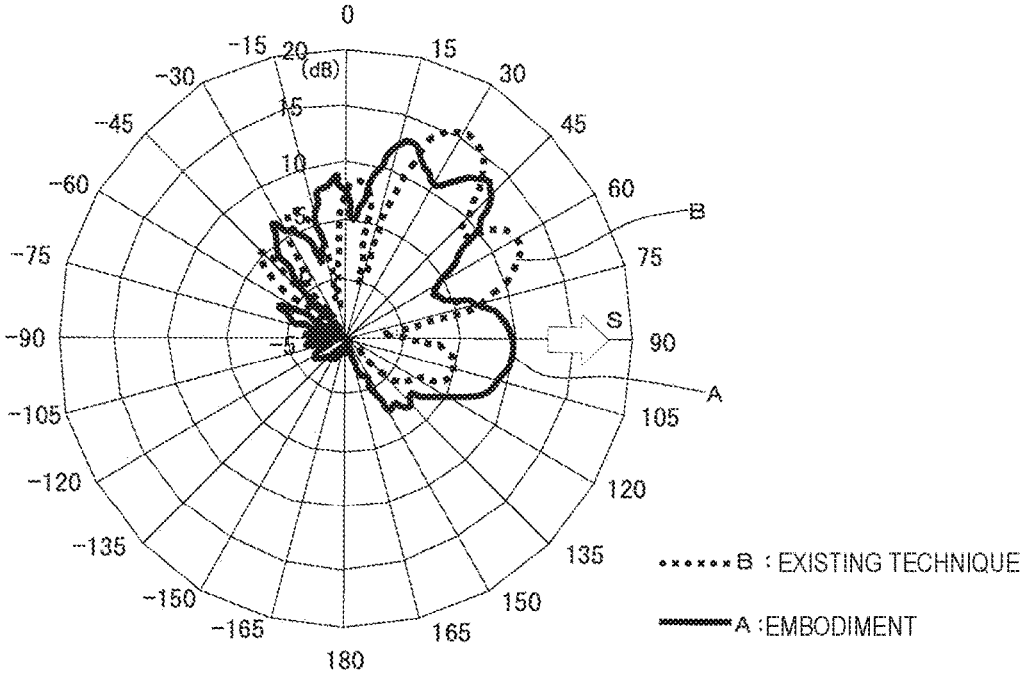
FIG. 6B is a directivity diagram for comparing lateral-direction antenna radiation patterns of dipole antennas between the embodiment and the existing technique.

FIGS. 6A and 6B include directivity diagrams illustrating antenna characteristics of the RF antenna module 32 accommodated in the housing 31 with the antenna module accommodation structure in the first embodiment illustrated in FIG. 5B and antenna characteristics of the RF antenna module 32 accommodated in the housing 31 with an existing antenna module accommodation structure illustrated in FIG. 5C in a comparison manner. The existing structure illustrated in FIG. 5C is different from the structure in the first embodiment illustrated in FIG. 5B only in a point that the RF antenna module 32 is not accommodated in the slit 40, and the fore surface side of the RF antenna module 32 is made to adhere to and be fixed to the rear surface of the side plate 31*a* with a double-faced adhesive tape 43 to be accommodated in the housing 31.

FIG. 6A is a directivity diagram for comparing front-direction antenna radiation patterns of the patch antennas 34 configuring the front-direction radiation antennas between the embodiment and the existing technique, and FIG. 6B is a directivity diagram for comparing lateral-direction antenna radiation patterns of the dipole antennas 35 on the right side ends of the substrates 33, which configure the lateral-direction radiation antennas, between the embodiment and the existing technique. In each of these directivity diagrams, a characteristic line A drawn by a solid line indicates the directivity in the antenna module accommodation structure in the first embodiment and a characteristic line B drawn by a dotted line indicates the directivity in the antenna module accommodation structure in the existing technique.

It is understood from the directivity diagram illustrated in FIG. 6A that a radio wave emission level of the patch antennas 34 in the antenna module accommodation structure in the first embodiment in the front direction, which is indicated by the characteristic line A, is higher than that of the patch antennas 34 in the antenna module accommodation structure in the existing technique, which is indicated by the characteristic line B. As is seen from the directivity diagram illustrated in FIG. 6B, a radio wave emission level of the dipole antennas 35 in the antenna module accommodation structure in the existing technique in the lateral direction is obliquely biased to the fore side as indicated by the characteristic line B, whereas a radio wave emission level of the dipole antennas 35 in the antenna module accommodation structure in the first embodiment in the lateral direction is such that components traveling straight in the lateral direction of 90° are increased as indicated by the characteristic line A.

Figure 1:
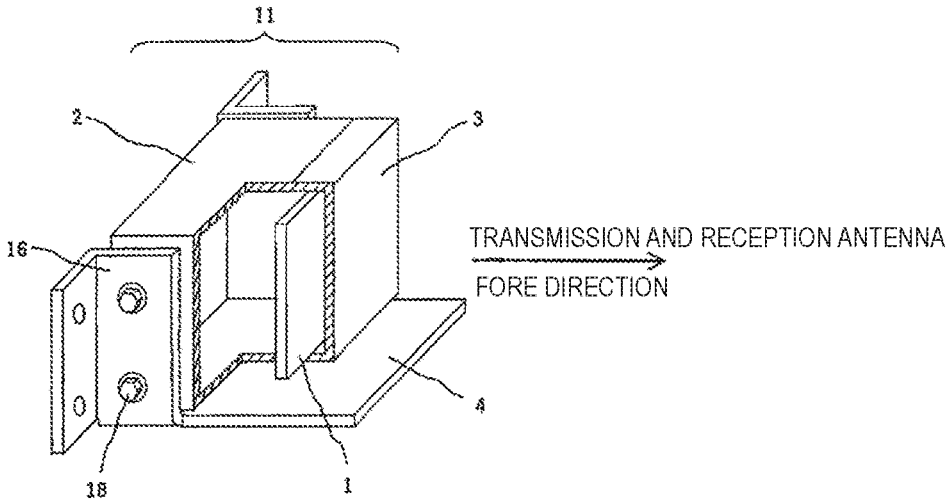
FIG. 1 is a partially cutaway perspective view illustrating a first existing antenna module accommodation structure.

As described above, with the antenna module accommodation structure in the first embodiment, the RF antenna module 32 is accommodated in the housing 31 only by simply housing the RF antenna module 32 in the slit 40 formed in the side plate 31*a* of the housing 31, as illustrated in FIGS. 5A and 5B. Therefore, the RF antenna module 32 need not be fixed to the side plate 31*a* in the housing 31 with the double-faced adhesive tape 43 or the like as illustrated in FIG. 5C for housing the RF antenna module 32 in the housing 31, unlike the existing structure illustrated in FIG. 1. Accordingly, no gap for the double-faced adhesive tape 43 or the like is formed between the patch antennas 34 and the side plate 31*a*. As a result, the intensity of the radio waves that are emitted from the patch antennas 34 to the fore side of the side plate 31*a* in the front direction F with the side plate 31*a* interposed therebetween is not weakened and the antenna characteristics are improved as illustrated in the directivity diagram in FIG. 6A.

Figure 3:
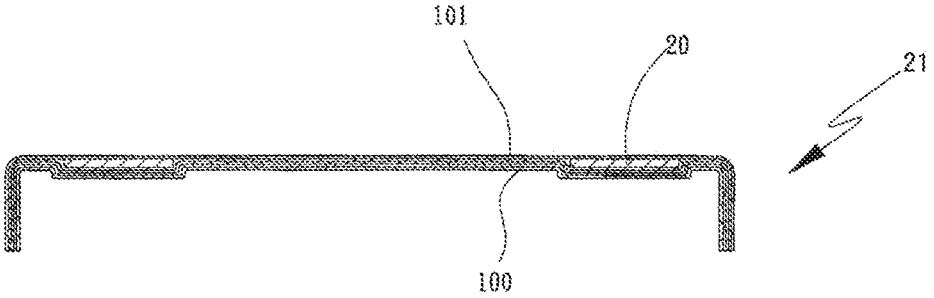
FIG. 3 is a cross-sectional view illustrating a third existing antenna module accommodation structure.

Furthermore, the number of processes for mounting the RF antenna module 32 in the housing 31 is reduced because the RF antenna module 32 is accommodated in the housing 31 only by simply housing the RF antenna module 32 in the slit 40. Therefore, unlike the existing structure illustrated in FIG. 3, the RF antenna module 32 can be accommodated in the housing 31 easily and rapidly without the process of putting the antenna module in the cavity opened in the molding mold and integrally molding with the resin.

Figure 2:
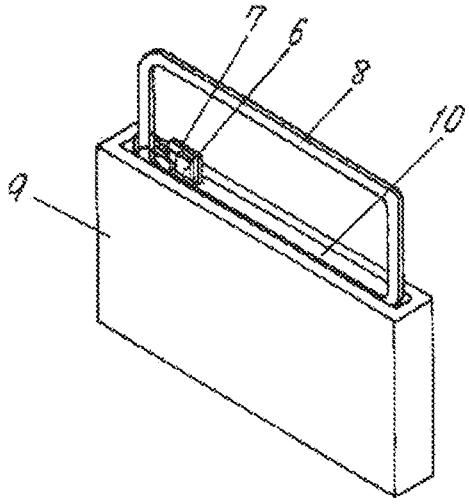
FIG. 2 is a perspective view illustrating a second existing antenna module accommodation structure.

Moreover, the accommodation capacity for devices capable of being accommodated in the housing 31 is not reduced because the RF antenna module 32 is housed in the slit 40 formed in the side plate 31*a* of the housing 31 and does not protrude into an internal space of the housing 31. Therefore, a problem that devices other than the antenna module cannot be accommodated due to accommodation of the antenna module in the housing is not raised unlike the existing structure illustrated in FIG. 2.

Furthermore, in the first embodiment, the RF antenna module 32 is housed in the slit 40 formed in the side plate 31*a* of the housing 31 easily and rapidly by inserting the one side of the substrate 33 through the opening 40*a* of the slit 40, which is formed in the upper end surface of the side plate 31*a*, and inserting the substrate 33 into the slit 40 by the amount equal to or larger than the length b of the other side of the substrate 33.

In addition, in the first embodiment, the RF antenna module 32 is accommodated in the slit at a predetermined arrangement position in the depth direction thereof only by inserting the RF antenna module 32 into the slit 40 down to the depth D to be simply housed in the slit 40. Therefore, a position in the height direction of the housing 31 at which the RF antenna module 32 is mounted on the side plate 31*a* is automatically determined only by performing a process of housing the RF antenna module 32 in the slit 40 and assembly of the RF antenna module 32 in the housing 31 is made easy.

Furthermore, in the first embodiment, the position of the RF antenna module 32 is fixed in the slit 40 by pressing the metal case 36 exposed to the cavity 40*b* formed in the slit 40 to the front side of the side plate 31*a* on the fore side of the slit 40 by the heat sink 41. The position of the RF antenna module 32 is reliably fixed in the slit 40 by pressing the metal case 36 by the heat sink 41. However, the RF antenna module 32 is supported on the heat sink 41 and the position thereof is fixed in the slit 40 only by causing the metal case 36 to adhere to the heat sink 41 with the double-faced adhesive tape 42 without pressing the metal case 36 by the heat sink 41. Moreover, heat generated in the RF antenna module 32 can be released from the heat sink 41 by fixing the RF antenna module 32 to the heat sink 41 in this manner.

In the existing antenna module accommodation structure with which the RF antenna module 32 is fixed to the rear surface of the side plate 31*a* with the double-faced adhesive tape 43 or the like to be accommodated in the housing 31 as illustrated in FIG. 5C, the side plate 31*a* is present on the fore side of the side ends of the substrate 33 on which the dipole antennas 35 are formed and spaces are present on the back side of the side ends of the substrate 33. Therefore, materials having different dielectric constants are asymmetrically present on the fore and back sides of the side ends of the substrate 33 centered to the side ends of the substrate 33. Accordingly, the radio waves that are emitted from the dipole antennas 35 in the lateral directions S of the side plate 31*a* do not travel straight along the lateral directions of the side plate 31*a* and propagate being biased to the fore direction of the side plate 31*a* as indicated by the characteristic line B in the directivity diagram in FIG. 6B.

However, with the accommodation structure in the first embodiment illustrated in FIG. 5B with which the substrate 33 is accommodated in the slit 40 formed in the side plate 31*a*, the side plate 31*a* is equally present at the fore and back sides of the side ends of the substrate 33 on which the dipole antennas 35 are formed and a material having the same dielectric constant is symmetrically present centered to the side ends of the substrate 33. Accordingly, radio waves that are emitted from the dipole antennas 35 in the lateral directions S of the side plate 31*a* are difficult to be biased to the fore direction of the side plate 31*a* and components that propagate along the lateral directions of the side plate 31*a* are increased as indicated by the characteristic line A in the directivity diagram in FIG. 6B. As a result, lateral-direction antenna characteristics of the dipole antennas 35 are improved.

Next, antenna module accommodation structures according to second and third embodiments of the disclosure will be described.

Figure 7A:
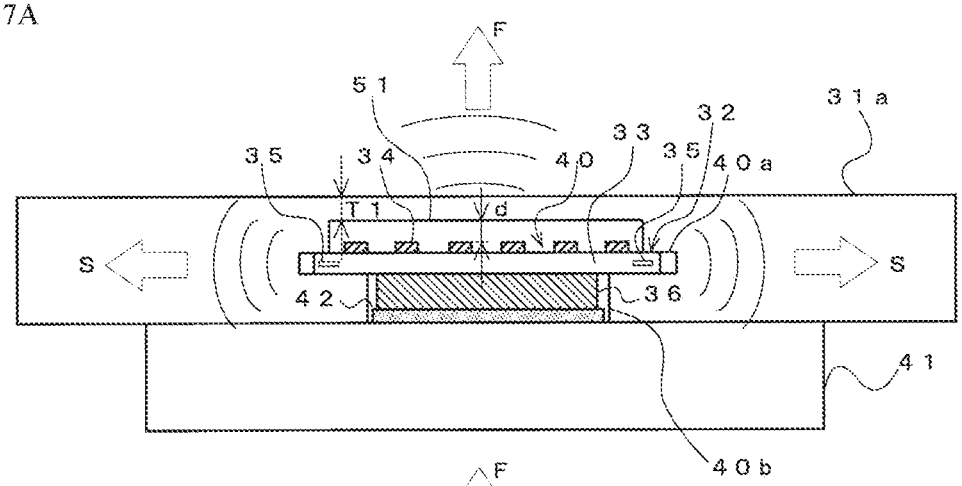
FIG. 7A is a plan view illustrating an antenna module accommodation structure in a second embodiment of the disclosure.
Figure 7B:
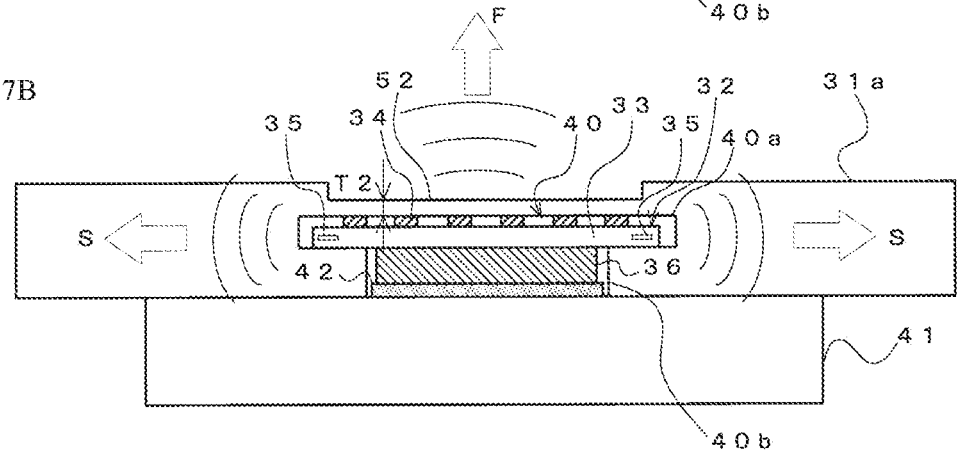
FIG. 7B is a plan view illustrating an antenna module accommodation structure in a third embodiment of the disclosure.

FIG. 7A is a plan view illustrating the antenna module accommodation structure in the second embodiment. In FIGS. 7A and 7B, the same reference numerals denote the portions that are the same as or correspond to those in FIG. 5B and description thereof is omitted.

The antenna module accommodation structure in the second embodiment is different from the antenna module accommodation structure in the above-described first embodiment only in a point that the thickness T1 of the side plate 31*a* at the front side on the fore side of the slit 40 is reduced at the internal portion side of the housing 31 and a rectangular groove 51 is formed on the fore side of the slit 40.

With this configuration, an amount by which the thickness T1 of the side plate 31*a* at the front side on the fore side of the slit 40 is reduced at the internal portion side of the housing 31 is adjusted to adjust a distance d between the patch antennas 34 formed on the fore surface of the substrate 33 and the side plate 31*a* present at the fore side of the substrate 33 and the thickness T1 of the side plate 31*a* present at the fore side of the substrate 33. With this, a beam width and a radiation power level of the radio waves that the patch antennas 34 emit toward the front fore side of the side plate 31*a* can respectively be set to a desired beam width and a desired radiation power level, thereby providing preferable antenna characteristics.

FIG. 7B is a plan view illustrating the antenna module accommodation structure in the third embodiment.

The antenna module accommodation structure in the third embodiment is different from the antenna module accommodation structure in the above-described first embodiment only in a point that a thickness T2 of the side plate 31*a* at the front side on the fore side of the slit 40 is reduced at the outer portion side of the housing 31 and a rectangular groove 52 is formed in the fore surface of the side plate 31*a*.

With this configuration, an amount by which the thickness T2 of the side plate 31*a* at the front side on the fore side of the slit 40 is reduced at the outer portion side of the housing 31 is adjusted to adjust the thickness T2 of the side plate 31*a* present on the fore side of the patch antennas 34 formed on the fore surface of the substrate 33. With this, a beam width and a radiation power level of the radio waves that the patch antennas 34 emit toward the front fore side of the side plate 31*a* can respectively be set to a desired beam width and a desired radiation power level, thereby providing preferable antenna characteristics.

In the above-described respective embodiments, the opening 40*a* of the slit 40 formed in the side plate 31*a* is opened in the upper end surface of the side plate 31*a* as illustrated in FIG. 5A. However, a slit 40A may be formed such that the opening 40*a* is opened in the side end surface of the side plate 31*a* as illustrated in FIG. 8.

Figure 8:
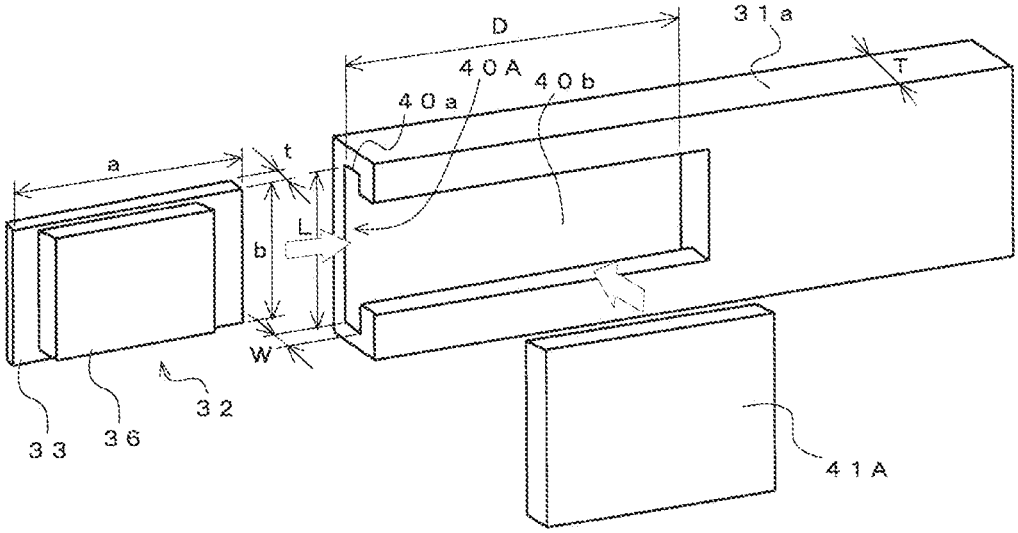
FIG. 8 is a partially enlarged perspective view in which respective components are seen from the rear surface side of a side plate when an RF antenna module is accommodated in the side plate in a variation of the antenna module accommodation structure in each of the embodiments.

FIG. 8 is a partially enlarged perspective view in which respective components are seen from the rear surface side of the side plate 31*a* when the RF antenna module 32 is accommodated in the side plate 31*a* in a variation of the antenna module accommodation structure in each of the above-described embodiments. In FIG. 8, the same reference numerals denote the portions that are the same as or correspond to those in FIG. 5A and description thereof is omitted.

The opening 40*a* of the slit 40A has a width W which is smaller than the thickness T of the side plate 31*a* and enables to correspond to the thickness t of the substrate 33 and a length L which enables to correspond to the length b of one side on a shorter side of the substrate 33. Furthermore, the slit 40A has a depth D which is equal to or larger than a length a of the other side, which is a side on a longer side, of the substrate 33. The depth D of the slit 40A is set in accordance with an arrangement position of the RF antenna module 32 in the side plate 31*a* in the width direction.

The RF antenna module 32 is housed in the slit 40A formed in the side plate 31*a* of the housing 31 to be accommodated in the housing 31 by, from the lateral side of the side plate 31*a*, inserting the one side on the shorter side of the substrate 33 through the opening 40*a* of the slit 40A formed in the side end surface of the side plate 31*a* and inserting the substrate 33 into the slit 40A by an amount equal to or larger than the length a of the other side on the longer side of the substrate 33. Furthermore, a plate-shaped heat sink 41A is bonded to the metal case 36 exposed to the cavity 40*b* with the double-faced adhesive tape 42. The heat sink 41A is fixed to the rear surface of the side plate 31*a* with screws at both upper and lower end portions thereof with the cavity 40*b* interposed therebetween. The fixing of the heat sink 41A causes the heat sink 41 to press the metal case 36 exposed to the cavity 40*b* to the front side of the side plate 31*a* and fixes a position of the RF antenna module 32 in the slit 40A.

The antenna module accommodation structure in the variation can also provide the same action effects as those obtained with the antenna module accommodation structure in each of the above-described embodiments.

An antenna module accommodation structure according to the present disclosure can be used when an RF antenna module is accommodated in a housing of a wireless dock making wireless LAN communication at high speed with millimeter radio waves. The above wireless LAN communication is made between devices with a short distance therebetween while the emitted radio waves are caused to have directivity by beam forming under the WiGig standards.

30 HOUSING
31*a* SIDE PLATE
T, T1, T2 THICKNESS OF SIDE PLATE 31*a*
32 RF ANTENNA MODULE
33 SUBSTRATE
a LENGTH OF ONE SIDE (OTHER SIDE) OF SUBSTRATE 33
b LENGTH OF OTHER SIDE (ONE SIDE) OF SUBSTRATE 33
t THICKNESS OF SUBSTRATE 33
34 PATCH ANTENNA (FRONT-DIRECTION RADIATION ANTENNA)
35 DIPOLE ANTENNA (LATERAL-DIRECTION RADIATION ANTENNA)
36 METAL CASE
40, 40A SLIT
40*a* OPENING
40*b* CAVITY
W WIDTH OF OPENING 40*a*
L LENGTH OF OPENING 40*a*
D DEPTH OF SLIT 40 AND SLIT 40A
41, 41A HEAT SINK
42, 43 DOUBLE-FACED ADHESIVE TAPE
51, 52 GROOVE

The invention claimed is:

1. An antenna module accommodation structure comprising an antenna module having an antenna disposed in or on a substrate, wherein the antenna module is housed in a slit provided in a side plate of a housing to be accommodated in the housing, and wherein a depth of the slit is set in accordance with an arrangement position of the antenna module in the side plate.

2. The antenna module accommodation structure according to claim 1, wherein a rear surface side of the side plate on a back side of the slit facing an internal portion of the housing is cut out and a cavity causing a part of the accommodated antenna module to be exposed to the internal portion of the housing is provided in the slit.

3. The antenna module accommodation structure according to claim 2, wherein the antenna comprises a front-direction radiation antenna emitting radio waves toward a front fore side of the side plate exposed to an outside of the housing and a lateral-direction radiation antenna emitting radio waves in a lateral direction of the side plate.

4. The antenna module accommodation structure according to claim 2, wherein a thickness of the side plate at a front side on a fore side of the slit exposed to an outside of the housing is reduced at an internal portion side of the housing.

5. The antenna module accommodation structure according to claim 2, wherein a thickness of the side plate at a front side on a fore side of the slit exposed to an outside of the housing is reduced at an outer portion side of the housing.

6. The antenna module accommodation structure according to claim 1, wherein the antenna comprises a front-direction radiation antenna emitting radio waves toward a front fore side of the side plate exposed to an outside of the housing and a lateral-direction radiation antenna emitting radio waves in a lateral direction of the side plate.

7. The antenna module accommodation structure according to claim 6, wherein a thickness of the side plate at a front side on a fore side of the slit exposed to an outside of the housing is reduced at an internal portion side of the housing.

8. The antenna module accommodation structure according to claim 6, wherein a thickness of the side plate at a front side on a fore side of the slit exposed to an outside of the housing is reduced at an outer portion side of the housing.

9. The antenna module accommodation structure according to claim 1, wherein a thickness of the side plate at a front side on a fore side of the slit exposed to an outside of the housing is reduced at an internal portion side of the housing.

10. The antenna module accommodation structure according to claim 1, wherein a thickness of the side plate at a front side on a fore side of the slit exposed to an outside of the housing is reduced at an outer portion side of the housing.

11. The antenna module accommodation structure according to claim 1, wherein the slit is open to at least two adjacent surfaces of the side plate.

12. An antenna module accommodation structure comprising an antenna module having an antenna disposed in or on a substrate, wherein the antenna module is housed in a slit provided in a side plate of a housing to be accommodated in the housing, and wherein the antenna comprises a front-direction radiation antenna emitting radio waves toward a front fore side of the side plate exposed to an outside of the housing.

13. The antenna module accommodation structure according to claim 12, wherein a thickness of the side plate at a front side on a fore side of the slit exposed to the outside of the housing is reduced at an internal portion side of the housing.

14. The antenna module accommodation structure according to claim 12, wherein a thickness of the side plate at a front side on a fore side of the slit exposed to the outside of the housing is reduced at an outer portion side of the housing.

15. The antenna module accommodation structure according to claim 12, wherein the slit is open to at least two adjacent surfaces of the side plate.

16. An antenna module accommodation structure comprising an antenna module having an antenna disposed in or on a substrate, wherein the antenna module is housed in a slit provided in a side plate of a housing to be accommodated in the housing, and wherein the antenna comprises a lateral-direction radiation antenna emitting radio waves in a lateral direction of the side plate.

17. The antenna module accommodation structure according to claim 16, wherein a thickness of the side plate at a front side on a fore side of the slit exposed to an outside of the housing is reduced at an internal portion side of the housing.

18. The antenna module accommodation structure according to claim 16, wherein a thickness of the side plate at a front side on a fore side of the slit exposed to an outside of the housing is reduced at an outer portion side of the housing.

19. The antenna module accommodation structure according to claim 16, wherein the slit is open to at least two adjacent surfaces of the side plate.

* * * * *